US006928250B1

(12) United States Patent
Adams et al.

(10) Patent No.: US 6,928,250 B1
(45) Date of Patent: Aug. 9, 2005

(54) CLOSED LOOP CONTROL FUNCTION FOR CORONA DEVICE

(75) Inventors: Jerry F. Adams, Waterport, NY (US); Susan A. Turner, Pittsford, NY (US); William R. Haag, Rochester, NY (US); Thomas E. Higgins, Fairport, NY (US); Joseph L. Filion, Fairport, NY (US); Andrew J. Bonacci, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/832,605

(22) Filed: Apr. 27, 2004

(51) Int. Cl.[7] ..... G03G 15/00
(52) U.S. Cl. ..... 399/45; 399/66; 399/311
(58) Field of Search ..... 399/45, 50, 66, 399/311

(56) References Cited

U.S. PATENT DOCUMENTS 5,585,908 A * 12/1996 Rakov et al. ..... 399/311
5,890,030 A * 3/1999 Namekata et al. ..... 399/66

* cited by examiner

*Primary Examiner*—Arthur T. Grimley
*Assistant Examiner*—Peter Lee
(74) *Attorney, Agent, or Firm*—Lloyd F. Bean, II

(57) ABSTRACT

An electrophotographic printing machine of the type having a latent image recorded on an imaging member wherein said latent image is developed and transferred to a media substrate during successive printing cycles of successive print jobs, including a charging device for producing a voltage potential on the media substrate to transfer the developed latent image to the media substrate, said charging device including a coronode member and shield; a first voltage supply for apply a shield voltage to said shield; a second voltage supply for applying a wire voltage to said coronode member; a voltage monitor for measuring the voltage on the shield, said voltage monitor periodically polling the voltage during a cycle of a print job and generating a voltage measured signal as a function thereof; controller, responsive to a media type of each media substrate and said voltage monitor, for adjusting said wire voltage to said coronode member in respect to said shield voltage to said shield to compensate for process impedance as said media substrate passes under said charging device to obtained desirable image transfer.

18 Claims, 6 Drawing Sheets

CLOSED LOOP CONTROL FUNCTION FOR CORONA DEVICE

BACKGROUND

The present invention relates generally to an apparatus for generating a substantially uniform charge on a surface, and, more particularly, concerns closed loop control function for corona device, primarily for use in electrostatographic applications. One example of such an application is the corotron used to transfer a developed image from a photoreceptor to a media substrate.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The process of transferring charged toner particles from an image support surface to a second support surface, such as a copy sheet is realized at a transfer station. In a conventional transfer station, transfer is achieved by applying electrostatic force fields in a transfer region sufficient to overcome forces which hold the toner particles to the photoconductive surface on the photoreceptive member. These electrostatic force fields operate to attract and transfer the toner particles over onto the second support surface which may be either an intermediate transfer belt or an output copy sheet.

An intermediate transfer belt is desirable for use in tandem color or one-pass paper duplex applications where successive toner powder images are transferred onto a single output copy sheet. These systems may also utilize multiple photoconductive drums or belts in lieu of a single photoconductive drum or belt. Historically, transfer of developed toner images between support surfaces in electrostatographic applications is often accomplished via electrostatic induction using a corotron or other corona generating device. In corona induced transfer systems, the second support surface, such as an intermediate support member or an output copy sheet, is placed in direct contact with the developed toner image being supported on the image bearing surface (typically, a photoconductive surface) while the back of the second support surface is sprayed with a corona discharge. This corona discharge generates ions having a polarity opposite that of the toner particles, thereby electrostatically attracting and transferring the toner particles from the image bearing surface to the second support surface.

In modem printing engines it is advantageous to operate over a wide range of settings for corona devices such as the shield current settings for Transfer/Detack corotron devices in order to be effective with a wide range of print media types. However, it is not possible to optimize the behavior of the corona device over such wide operating spaces with simple constant settings. This is further aggravated by the inherent difficulties of measuring high voltage AC signals, which is a primary control variable for corotron behavior.

In accordance with an aspect of the invention, there is provided a system to actively adjust the wire voltage setting on the basis of Transfer or Detack shield voltage operation. That is, with the shield power supply delivering the proper current (for example as designated for the print media in use) the system monitors the shield voltage and if this voltage is determined to be non-optimal the system adjusts the wire voltage setting appropriately. The wire voltage is adjusted gradually over time because as it changes it will in turn alter the corona so as to change process shield impedance and induce shield voltage, thereby changing the needed wire voltage adjustment. With this process, a coordinated change in wire voltage and shield voltage occurs until an optimum combined setting is achieved. This gradual change allows continuous real time indication of such things as corona device health, media condition and environmental conditions.

There is provided an electrophotographic printing machine of the type having a latent image recorded on an imaging member wherein said latent image is developed and transferred to a media substrate during successive printing cycles of successive print jobs, including a charging device for producing a voltage potential on the media substrate to transfer the developed latent image to the media substrate, said charging device including a coronode member and shield; a first voltage supply for apply a shield voltage to said shield; a second voltage supply for applying a wire voltage to said coronode member; a voltage monitor for measuring the voltage on the shield, said voltage monitor periodically polling the voltage during a cycle of a print job and generating a voltage measured signal as a function thereof; controller, responsive to a media type of each media substrate and said voltage monitor, for adjusting said wire voltage to said coronode member in respect to said shield voltage to said shield to compensate for process impedance as said media substrate passes under said charging device to obtained desirable image transfer.

These and other aspects of the present invention will become apparent from the following description in conjunction with the accompanying drawings in which.

Figure 1:
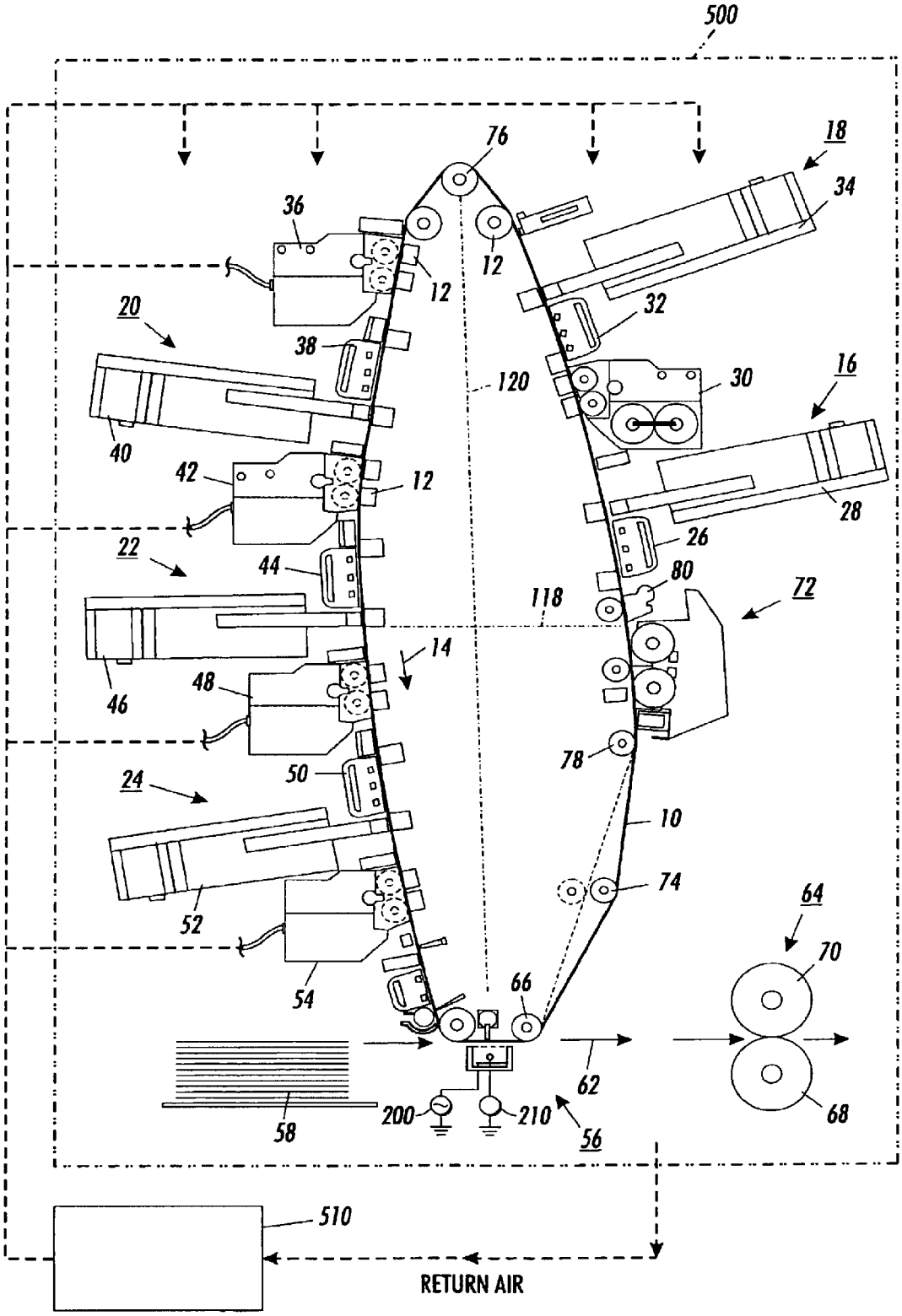
FIG. 1 is a schematic view of a single pass multi-color printing machine.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Developer unit 48 deposits magenta toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Figure 2:
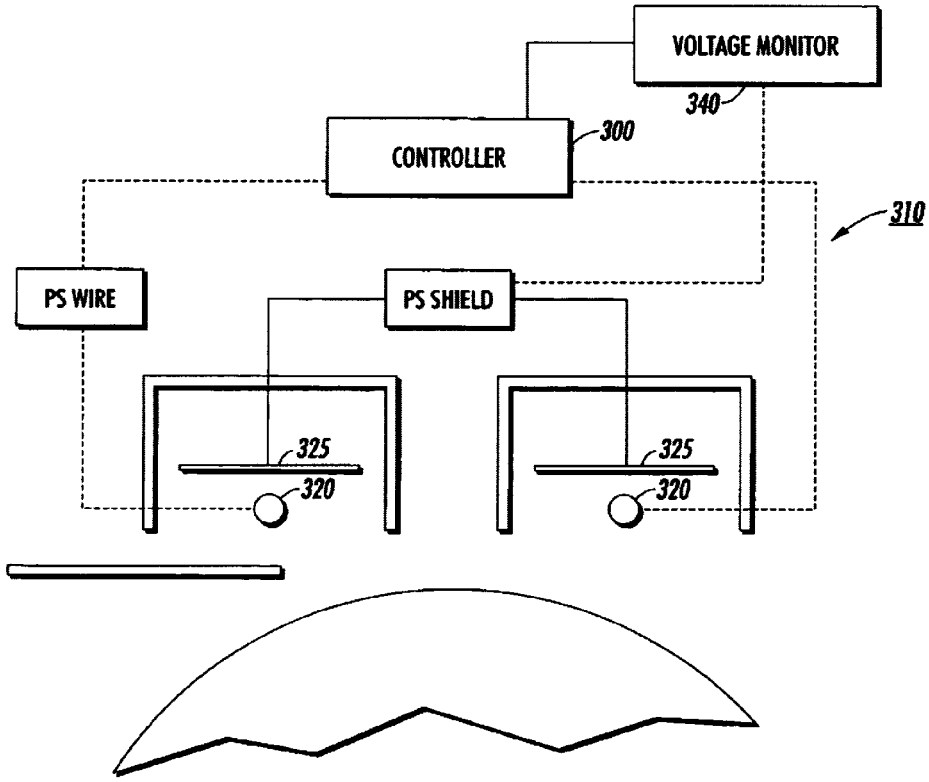
FIG. 2 is a schematic view of transfer/detack station in accordance with the present invention and showing the electrostatic operation of the system.

Referring now to FIG. 2, there are shown the details of transfer/detack station 56. Applicants have found that the charging device behavior is such that shield voltage is dependent on: geometry, device aging and contamination, media characteristics (thickness, dielectric constant, etc.) paper velocity, shield current setting, and wire voltage. The system includes a controller 300 to actuate and monitor three power supplies which in turn respectively drive and control the transfer shield current, detack shield current and wire voltage for both transfer and detack decorations. The process load impedances will induce a voltage response on the current-controlled devices and a current response on the voltage-controlled device. These responses are monitored by the controller 300 to determine the health and operational status of the system. Controller 300 may be either software or hardware derived. Controller 300 employs digital values corresponding to the power supply actuation levels. The digital values arrived at are converted by a digital to analog (D/A) converter for use in controlling the output of the power supplies. Target values for use in setting and adjusting the operation of the power supplies are provided by a system controller in accordance with system operational requirements.

Preferably charging device 60 employed in the present invention is a pair of dicorotrons 310. The dicorotrons produce a voltage potential on the media substrate to transfer the developed latent image onto the media substrate. The dicorotron includes a coronode member which is preferably a wire 320 and shield 325. Power supply provides a current source for supplying a constant current to shield. Voltage monitor 340 measures the voltage on the shield 325. The voltage monitor periodically polls the voltage during a cycle of a print job and generates a voltage measured signal as a function thereof.

One advantage of the present invention is that it is responsive to dynamic conditions of media movement, changes from one media to another, and setpoint changes, so as to maintain optimal operation of the various power supplies (with respect to fault occurrence and image quality). This has the effect of extending the overall range of media that can be handled effectively by the system, and facilitates interleaved mixed media printing.

Principles of the present invention were employed in an IGEN3® printing machine manufactured by Xerox Corporation which conventionally uses a high voltage system that employs controllers to perform local software-managed control and monitoring functions at the site of the high voltage power supplies. There are several analog controls and monitors for each high voltage power supply. For Transfer/Detack there are controls for Transfer shield current, Detack shield current and a common wire voltage. There are also monitors for Transfer shield voltage, Detack shield voltage, and combined wire current. In this conventional system, to partially overcome the problem described, the system adjusts the wire voltage setting between sheets for certain types of media only. This doesn't yield truly optimal transfer performance. Furthermore, it burdens the system controls to update the wire voltage setting in a time critical method and requires media-specific values.

Principles of the present invention are implemented by running control algorithms in the IGEN3® high voltage power supply controllers. In operation, the high voltage power supply controller periodically polls the shield voltage monitors. If these monitor signals meet the criteria established (too high or too low) the high voltage power supply controller would then adjust the wire voltage analog control. This is an iterative process. The next polling of the shield voltage monitors is used to further refine the wire voltage setting, etc.

The various analog monitors and controls are made available to the system controller. It is at the system controller level that the monitors and controls can be evaluated and inferences drawn to device health, media condition or environmental conditions.

Figure 3:
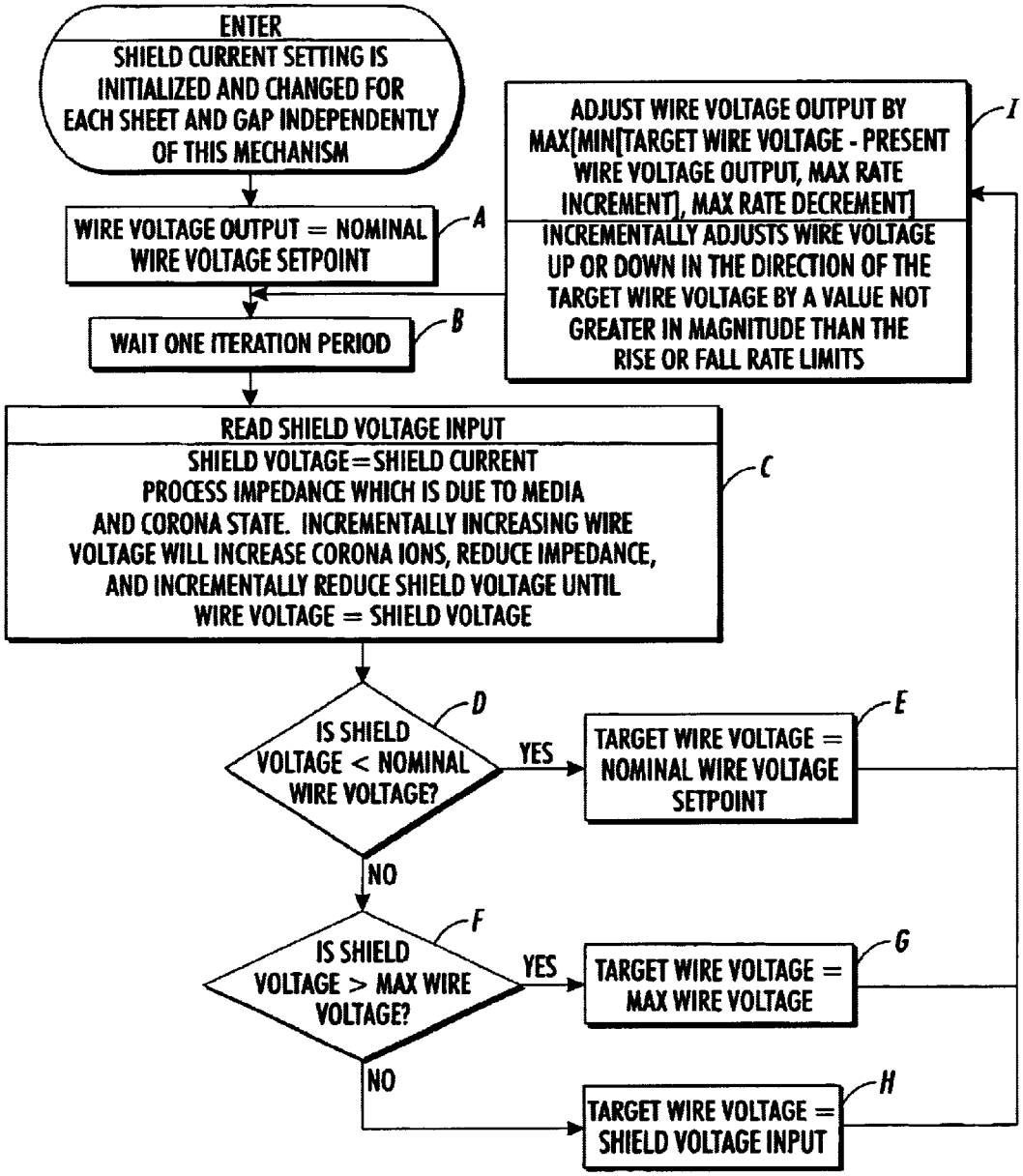
FIG. 3 is a flow chart illustrating the process of the present invention.
Figure 4:
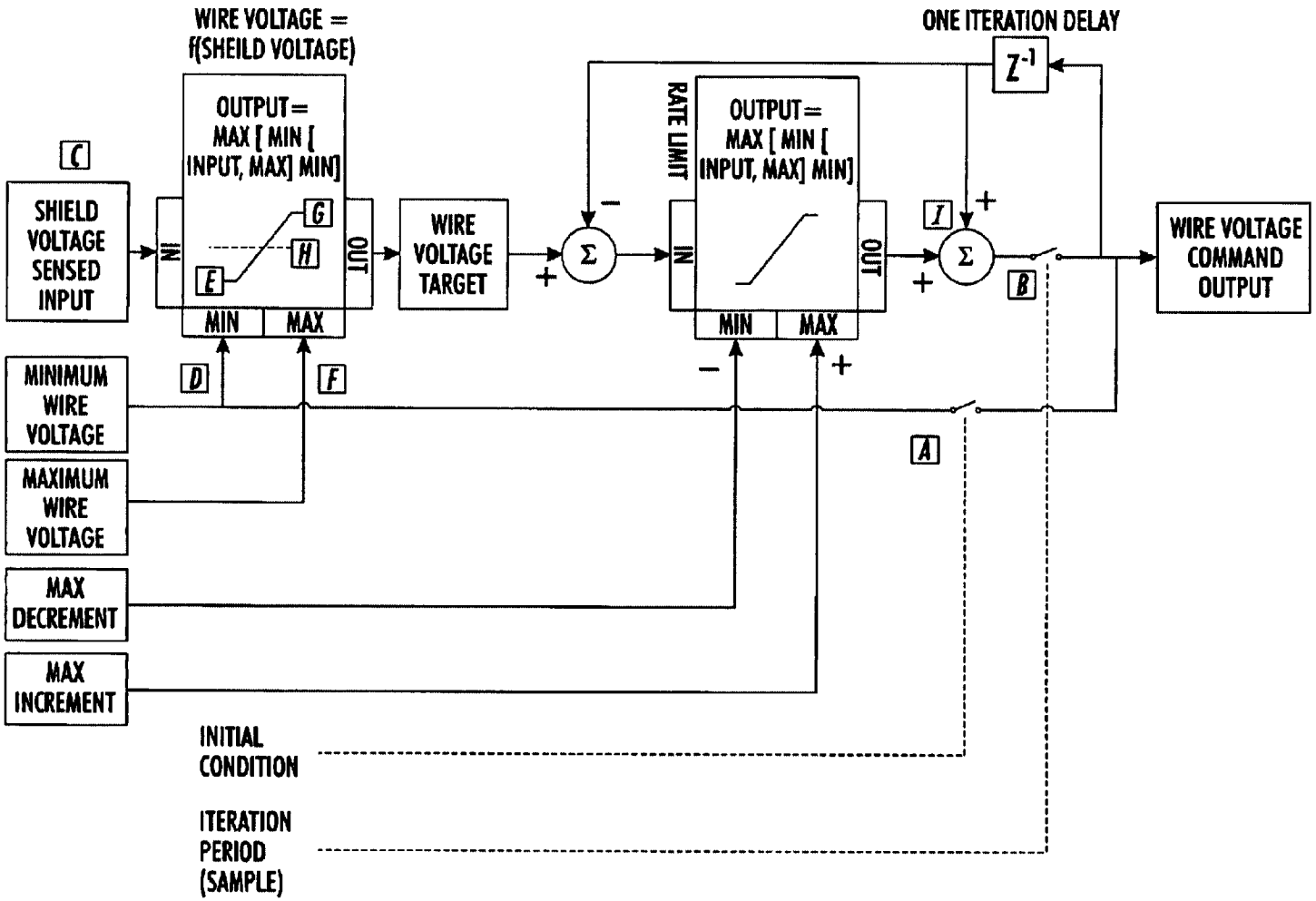
FIG. 4 is a block diagram representation of the feedback control loop performed by the microprocessor-controlled version of this function.

FIG. 3 is a flow chart illustrating the process of the present invention. FIG. 4 is an equivalent block diagram representation of the closed loop control function. Corresponding items in the flow chart and block diagram and labeled alphabetically are referenced in the following discussion, for example "[A]".

Figure 5:
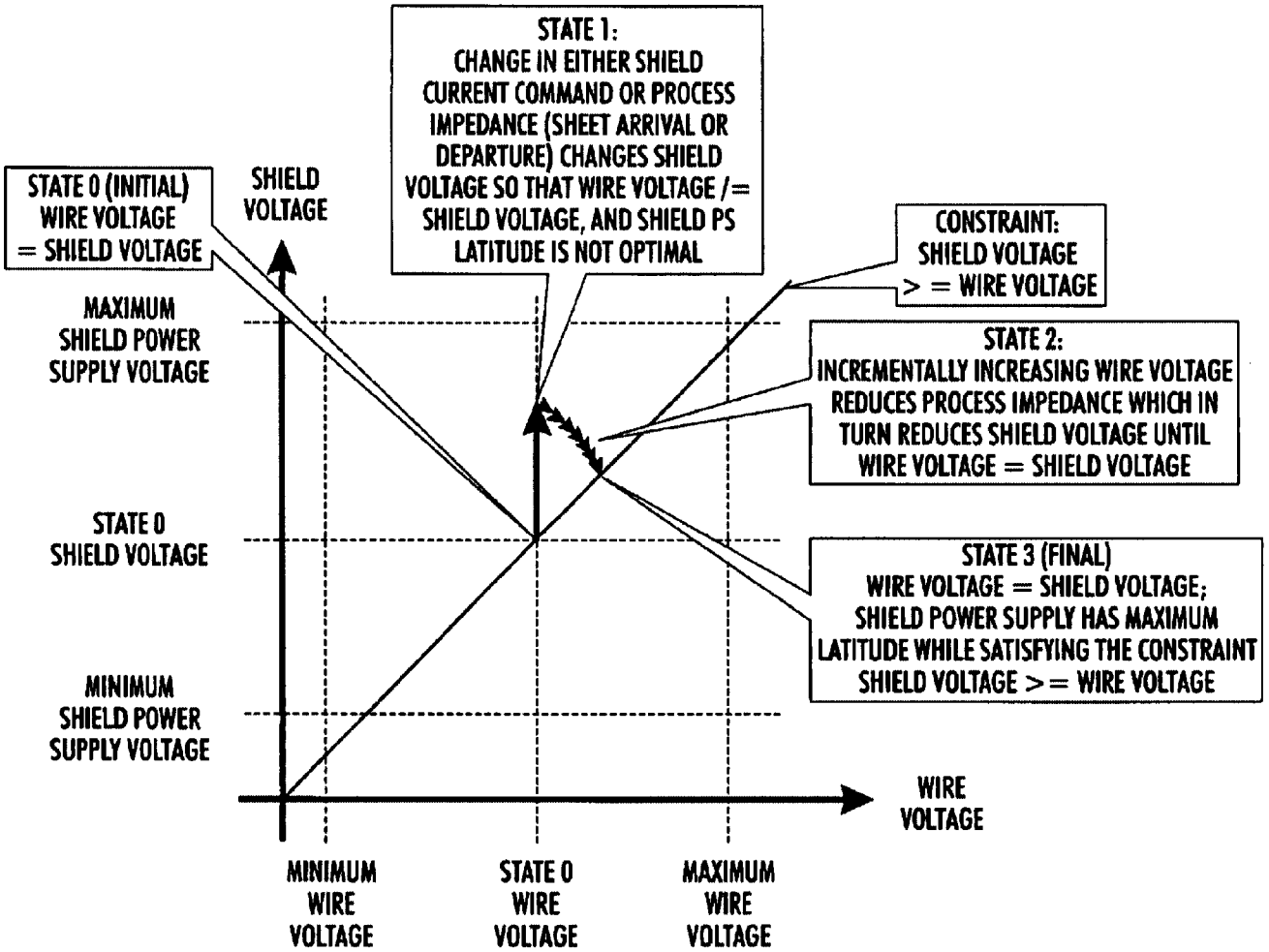
FIG. 5 is a graph of the behavior of the shield and wire voltages as monitored and controlled by this function per an example in which there is a sudden change in shield voltage due to either a change in load (arrival or departure of a sheet at the dicor) or a change in shield current command.

FIG. 5 is a plot of the effects of this process on the physical system as it iterates to a solution. Understanding the process of the present invention must include an understanding of the effects on the physical system, which in turn feeds back to and effects the process.

Note that the system controller sets the shield current independently of the mechanism of this invention. The shield current may be set distinctively for each individual sheet and for the gap between and preceding sheets as they move by the corona device. The shield current setting may be based on media properties or per the specific media as has been determined empirically to optimize image quality, operational latitude and fault occurrence. Any change in shield current or arrival of the sheet or inter-sheet gap to the corona device will directly affect shield voltage.

The process of this invention operates as follows (see FIG. 3).

[A] The wire voltage is initially set to the minimum allowed value as provided by the system controller.

[B] Subsequently the wire voltage adjustment will be iterated periodically at some regular interval. In the specific implementation an interval of 2 ms was provided. This will result in an adjustment of wire voltage dozens of times as a sheet passes over the corona device, maintaining the wire voltage setting to remain optimum for dynamic system changes. The periodic wire voltage adjustment consists of the following.

[C] The shield voltage is measured via an A/D converter.

[D] If the shield voltage is less than the minimum wire voltage, then [E] a target wire voltage is set to the minimum wire voltage.

[F] If the shield voltage is greater than the maximum wire voltage, then [G] the target wire voltage is set to the maximum wire voltage.

[H] Otherwise, the target wire voltage is set to the shield voltage.

[I] If the target wire voltage differs from the existing wire voltage, the wire voltage will be adjusted by a small increment in the direction of the target wire voltage.

FIG. 5 illustrates how this invention affects the behavior of the corona power supplies, and how this invention benefits the system.

In State 0 the system is in stasis at the optimal power supply state for the existing conditions. The shield voltage is as low as it can be, i.e. equal to the wire voltage, which reduces the chance of arcing. This state also provides the maximum possible headroom for the shield power supply under these conditions, If there is a sudden change in the load, the power supply will increase its output voltage to maintain the commanded current.

State 1 occurs as a result of changes in conditions, either in load or in commanded shield current, which results in a sudden change in shield voltage. This increases the chance of arcing and reduces the range that the shield power supply can continue to adjust if there is a further change. The conventional system would remain in this state until another load or command change occurs. Under the wide range of varying conditions encountered, the conventional system would be in a non-optimal state most of the time.

State 2 is the behavior of the system with this invention responding to these changes. The wire voltage is incrementally increased, increasing corona and reducing process load impedance, which in turn incrementally lowers induced shield voltage per the commanded shield current.

State 3 is the final condition where wire voltage has risen and shield voltage has decreased to the point where they are equal, which is again the optimal state for the available conditions.

Figure 6:
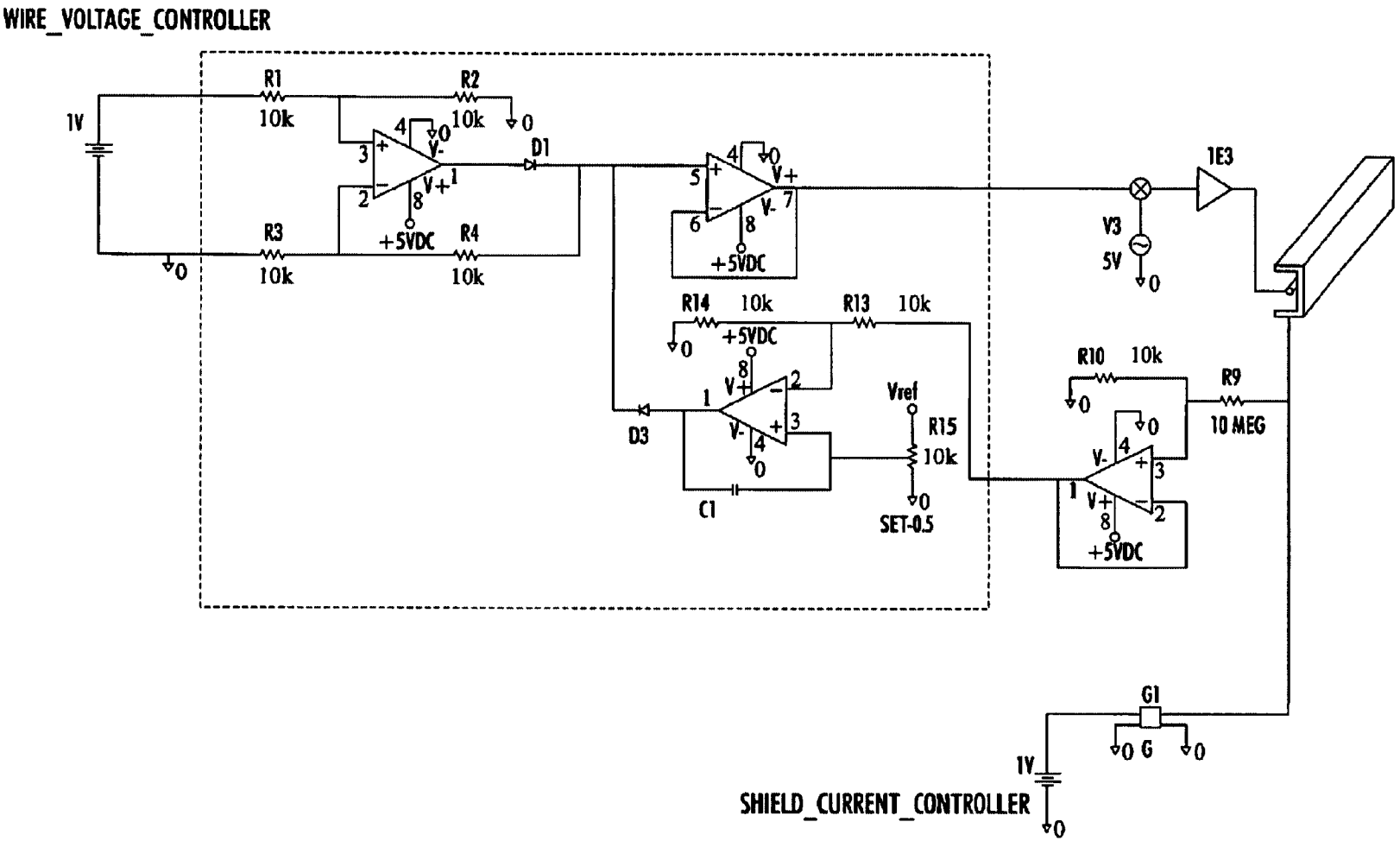
FIG. 6 is a schematic of an electronic circuit that performs the equivalent closed loop wire voltage control function disclosed by this invention.

FIG. 6 is a schematic diagram of an embodiment of this invention implemented in electrical hardware. The Wire Voltage Controller is a DC voltage source derived from machine controls that sets the nominal AC dicorotron wire voltage. In this application it will set the Minimum dicorotron wire voltage.

Gain 1 is a simple buffer amplifier with gain of 1. In the actual electrical schematic the diode D1 is incorporated within the op-amp feedback path to compensate for its forward voltage drop.

Gain 2 is a simple buffer amplifier with gain of 1.

V_AC_REF is a precision sine-wave source that generates a fixed amplitude AC sinusoidal voltage.

Mult 1 is a multiplier. This stage multiplies the wire voltage control signal derived in the Gain 2 stage and the AC_REF sinusoidal voltage to derive a controlled amplitude sine-wave voltage.

Gain 3 is a high voltage power amplifier that amplifies the output of Mult 1 to generate the actual AC dicorotron wire voltage.

Shield Current Controller is a DC voltage source derived from machine controls that sets the dicorotron shield current.

G1 is a voltage controlled current source that derives the actual dicorotron shield current from the controller voltage.

R9 and R10 comprise a voltage divider that divides the dicorotron shield DC voltage down to a low voltage useable in the circuitry of this invention.

Adjustable resistor R15 is a voltage divider connected to a reference voltage source that creates an adjustable voltage threshold.

Diff 1 and Gain 4 combine to form a difference amplifier. The output of this stage is the difference between the dicorotron shield voltage divider R9 and R10, and the adjustable threshold voltage source R15. Polarity is such that the output of Gain 4 increases as the dicorotron shield voltage increases.

Diodes D1 and D3 are connected such that the larger of the minimum AC dicorotron wire voltage setting (from Gain 1) and the error signal (from Gain 4) is selected to be amplified by Gain 2.

In operation the circuit works as follows: (keeping in mind that generally the DC shield voltage seen on a dicorotron is directly proportional to its DC shield current setting and indirectly proportional to its AC wire voltage setting).

Normally the Wire Voltage Controller receives a voltage setting from the machine controller and this voltage is buffered, multiplied by a sine-wave source and amplified to drive the dicorotron wire at a certain voltage. In this invention this control is still in place, but it may be overridden by a secondary control element. As long as the shield voltage is below a certain threshold this circuit behaves as described above. However when the dicorotron shield voltage, scaled by R9 and R10, exceeds a threshold, set by R15 the signal source for the dicorotron wire voltage generator is switched from the Wire Voltage Controller to the difference amplifier and AC wire voltage setting is increased. From the general characteristic of dicorotron shield voltage (indirect proportionality to wire voltage) it can be seen that the action of increasing wire voltage would reduce shield voltage.

The gain and bandwidth of Gain 4 are used to set the closed-loop characteristics of this control system. These parameters may be selected to cause the system to react gently or forcefully, gradually or abruptly to shield voltage feedback. In this application these parameters might, for instance, be chosen such that the system reacts forcefully and abruptly to shield voltage. With proper adjustment of R15 to set the threshold voltage to just below a dangerous or unreliable limit for the dicorotron shield voltage then this system would be completely unobtrusive to normal behavior unless the shield voltage approached a dangerous or unreliable value. At that point the system would forcefully react to prevent the shield voltage from reaching that value.

It should be evident to one skilled in the art is it obvious that this control system may be implemented by various means, including analog circuitry and digital devices, such as a state machine or microprocessor. One skilled in the art will also appreciate that the optimum combined setting of wire voltage and shield voltage can be any desired functional relationship to be implemented within the circuitry or digital control logic or algorithm. One skilled in the art will also appreciate that the dynamic behavior of the coordinated change in wire voltage and shield voltage may be controlled by appropriate use of filtering, rate limiting and other common analog and digital control system methods.

The optimum conditions for the example Transfer/Detack device are that the specified shield current is provided while shield voltage is as low as possible, but not lower than the wire voltage so as to minimize arcing and related faults, and to maximize the power supply headroom. The headroom is needed to allow power supply responsiveness to sudden changes in system properties, such as arrival and departure of media with respect to the corona device. In addition, excessive shield voltage can result in image defects or faults caused by various physical phenomena such as arcing.

For a given combination of system geometry, contamination, speed of operation, media attributes and corona conditions there will result a process impedance which loads the shield power supply. Consequently a shield voltage will be set by the power supply to achieve the shield current setting. For proper operation the shield voltage should not be lower than the wire voltage (within some tolerance). The extent to which the shield voltage exceeds the wire voltage is a corresponding reduction in the head-room of the shield power supply. Therefore, the system should provide a wire voltage and resultant corona which reduces process impedance so as to obtain a shield voltage at or near the wire voltage.

System operation is also constrained by limits on the voltage and current outputs of the shield and wire power supplies and a minimum wire voltage that will have the desired physical effect (corona).

It is, therefore, apparent that there has been provided in accordance with the present invention which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An electrophotographic printing machine of the type having a latent image recorded on an imaging member wherein said latent image is developed and transferred to a media substrate during successive printing cycles of successive print jobs, comprising:

a charging device for producing a voltage potential on the media substrate to transfer the developed latent image to the media substrate, said charging device including a coronode member and shield;

a first voltage supply for apply a shield voltage to said shield;

a second voltage supply for applying a wire voltage to said coronode member;

a voltage monitor for measuring the voltage on the shield, said voltage monitor periodically polling the voltage during a cycle of a print job and generating a voltage measured signal as a function thereof;

control means, responsive to a media type of each media substrate and said voltage monitor, for adjusting said wire voltage to said coronode member in respect to said shield voltage to said shield to compensate for process impedance as said media substrate passes under said charging device to obtained desirable image transfer.

2. An electrophotographic printing machine according to claim 1, wherein said control means incrementally adjust said wire voltage in a closed loop control as a media substrate passes under charging device.

3. An electrophotographic printing machine according to claim 2, wherein said closed loop control comprises determining; If the shield voltage is less than the minimum wire voltage, then a target wire voltage is set to the minimum wire voltage; If the shield voltage is greater than the maximum wire voltage, then the target wire voltage is set to the maximum wire voltage; Otherwise, the target wire voltage is set to the shield voltage; If the target wire voltage differs from the existing wire voltage, the wire voltage will be adjusted by a small increment in the direction of the target wire voltage.

4. An electrophotographic printing machine according to claim 1, wherein said voltage monitor periodically polls pitch to pitch to obtain desirable image transfer during interleaved mixed media substrate printing.

5. An electrophotographic printing machine according to claim 1, wherein said coronode member is a wire.

6. An electrophotographic printing machine according to claim 4, wherein said voltage monitor periodically polls about 2 msec.

7. An electrophotographic printing machine according to claim 1, further comprising a current source for supplying a constant current to said shield.

8. An electrophotographic printing machine according to claim 1, wherein said control means comprises software.

9. An electrophotographic printing machine according to claim 1, wherein said control means comprises a circuit.

10. An image transfer apparatus for transferring a develop image to a media substrate during successive printing cycles of successive print jobs, comprising:

a charging device for producing a voltage potential on the media substrate to transfer the developed latent image to the media substrate, said charging device including a coronode member and shield;

a first voltage supply for apply a shield voltage to said shield;

a second voltage supply for applying a wire voltage to said coronode member;

a voltage monitor for measuring the voltage on the shield, said voltage monitor periodically polling the voltage during a cycle of a print job and generating a voltage measured signal as a function thereof;

control means, responsive to a media type of each media substrate and said voltage monitor, for adjusting said wire voltage to said coronode member in respect to said shield voltage to said shield to compensate for process impedance as said media substrate passes under said charging device to obtained desirable image transfer.

11. An apparatus according to claim 10, wherein said control means incrementally adjust said wire voltage in a closed loop control as a media substrate passes under charging device.

12. An apparatus according to claim 11, wherein said closed loop control comprises determining; If the shield voltage is less than the minimum wire voltage, then a target wire voltage is set to the minimum wire voltage; if the shield voltage is greater than the maximum wire voltage, then the target wire voltage is set to the maximum wire voltage; Otherwise, the target wire voltage is set to the shield voltage; If the target wire voltage differs from the existing wire voltage, the wire voltage will be adjusted by a small increment in the direction of the target wire voltage.

13. An apparatus according to claim 10, wherein said voltage monitor periodically polls pitch to pitch to obtain desirable image transfer during interleaved mixed media substrate printing.

14. An apparatus according to claim 10, wherein said coronode member is a wire.

15. An apparatus according to claim 12, wherein said voltage monitor periodically polls about 2 msec.

16. An apparatus according to claim 10, further comprising a current source for supplying a constant current to said shield.

17. An apparatus according to claim 10, wherein said control means comprises software.

18. An apparatus according to claim 10, wherein said control means comprises a circuit.

* * * * *